United States Patent [19]

Moore

[11] 4,434,920

[45] Mar. 6, 1984

[54] SOFT ORTHOPEDIC POUCH-TYPE INFANT CARRIER

[75] Inventor: Ann A. Moore, Evergreen, Colo.

[73] Assignee: Snugli, Inc., Evergreen, Colo.

[21] Appl. No.: 350,877

[22] Filed: Feb. 22, 1982

[51] Int. Cl.[3] ..... A47D 13/02

[52] U.S. Cl. ..... 224/160; 224/215

[58] Field of Search ..... 224/158, 159, 160, 202, 224/209, 214, 215, 242, 257, 258, 259, 262

[56] References Cited

U.S. PATENT DOCUMENTS 3,162,343 12/1964 Anderson ..... 224/160

4,009,808 3/1977 Sharp ..... 224/160

FOREIGN PATENT DOCUMENTS 2404414 6/1979 France ..... 224/160

*Primary Examiner*—Steven M. Pollard

*Assistant Examiner*—David Voorhees

*Attorney, Agent, or Firm*—Edwin L. Spangler, Jr.

[57] ABSTRACT

This invention relates to an improved pouch-type infant carrier characterized by a drawstring subassembly extending transversely of the seat operative upon actuation to preset the maximum distance separating the leg openings so as to locate the latter directly behind the knees when the child is seated in the pouch with his or her legs open in spread-eagle relation, and a belt-forming appendage located adjacent the leg openings operative upon being drawn taut and tied or otherwise secured around the waist to cooperate with the drawstring subassembly to maintain the leg openings in preselected fixed spaced relation.

9 Claims, 6 Drawing Figures

SOFT ORTHOPEDIC POUCH-TYPE INFANT CARRIER

Pouch-type infant carriers are well known in the art, a prime example being that forming the subject matter of U.S. Pat. No. 3,481,517, the assignee of which is the inventor in the instant application. Carriers of this general type can accommodate infants only a few weeks old on up to young children who are still small and light enough to be carried on one's back. Carriers of the type shown in the patent aforementioned together with the following U.S. Pat. Nos.: 1,039,009; 3,327,914; 3,780,919; 4,139,131; 4,166,558; 4,234,227, are all so-called "soft carriers" meaning that they have no rigid frame whatsoever. On the other hand, the infant carrier forming the subject matter of U.S. Pat. No. 4,271,998 would not be characterized as a soft carrier because of its rigid frame in the seat area. Some of these carriers, at least with very small children, can be worn on either the back or the chest of the adult while others like all of those in the above list seem to be worn on the chest. Larger children are more easily carried on the back and they seem to prefer facing forwardly anyway.

In recent years those trained in orthopedics have come to recognize certain hip joint problems in young people which they now believe can, under some circumstances, be associated with the practice of supporting the child while very young by the buttocks while allowing the legs to hang down. The better way, they now feel, is to support the buttocks and the underside of the thigh all the way out to the knee joint in more or less "spread-eagle" fashion. When this practice is followed during the year or so immediately following birth, these hip problems disappear.

It is with this problem in mind that the pouch-type soft infant carrier forming the subject matter hereof was developed. A simple transversely-extending drawstring in the seat area of the pouch provides the means for adjusting the maximum spread between the leg openings. The user sets this adjustment to closely approximate the distance from the inside, or more properly backside, of one knee to the other when the upper legs or thighs are spread widely apart so as to extend out in opposite directions from the torso. In all but the position of maximum spread, the soft fabric of which the carrier is constructed ends up "gathered" underneath the thighs and buttocks due to the action of the drawstring.

The above, however, is only half of the solution to the problem because the drawstring is incapable of keeping the leg openings spread apart and, as a matter of fact, the child's tendency to hang his or her legs down as opposed to out to the side quickly causes the sought-after spread relationship to disappear as the leg openings are squeezed back toward one another. The unique solution to this problem comes by way of a belt-like appendage. In its simplest form, a couple of straps are fastened to the front panel alongside each leg opening that can be pulled taut and tied at the waist to maintain the desired spread relation. The preferred construction utilized the shoulder straps for this purpose. Strap-receiving loops are provided near the bottom front of the carrier alongside the leg openings through which these shoulder straps are reaved after passing under the arms preparatory to being tied at the waist. More specifically, when the child is being carried on the back, the shoulder straps pass forwardly over the shoulders and down the chest, (preferably without being crossed) then rearwardly under the arms to where they are reaved through the loops before being tied at the waist in front. Conversely, with the child being carried on the chest, the straps pass rearwardly over the shoulders and down the back where they preferably cross, forwardly under the arms and through the loops before being tied in the back at the waist. In any event, the shoulder straps and associated loops perform the same function as a separate belt when drawn taut and tied at the waist, namely, that of maintaining the adjusted spread between the leg openings permitted by the drawstring. Obviously, this cooperative action can be changed to accommodate infants from a few weeks to a year old or more which is the critical period in hip joint development that requires attention. More significant than accommodating different children is, of course, the ability to adjust the spread between the leg openings so as to match the growth of the same child. None of the prior art patents relating to pouch-type infant carriers, regardless of whether they include a rigid frame or not, even recognizes the problem yet alone provides a solution.

The carrier of the present invention also includes drawstrings at the waist and in the head or neck area; however, they do not cooperate with the waist-tie feature like the one in the seat. Besides, drawstrings, snap fasteners and other adjustment mechanisms in the waist and neck areas are commonplace in such carriers anyway.

Accordingly, it is the principal object of the present invention to provide a novel and improved soft pouch-type infant carrier.

A second objective is the provision of a device of the type aforementioned that includes means for both adjusting and maintaining a preselected spread between the leg openings.

Another object is the provision of a carrier for infants from birth up to a year or more old which can be worn both front and back while retaining its same leg opening spread adjustment feature.

An additional object is to provide a carrier of the type herein disclosed and claimed, the utility of which is undiminished for the older child who has outgrown the need for the orthopedic feature.

Further objects of the within described invention are to provide a soft carrier which is simple, versatile, easy to use, lightweight, safe, comfortable, washable and quite decorative.

Other objects will be in part apparent and in part pointed out specifically hereinafter in connection with the description of the drawings that follows, and in which.

Figure 6:
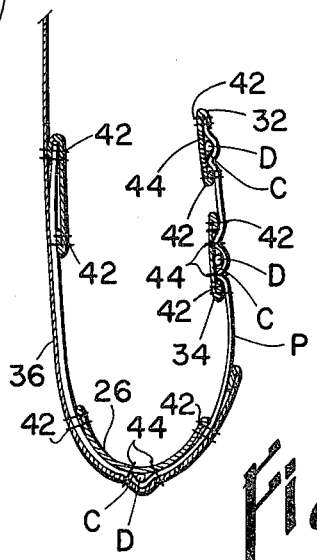
Figure 3:
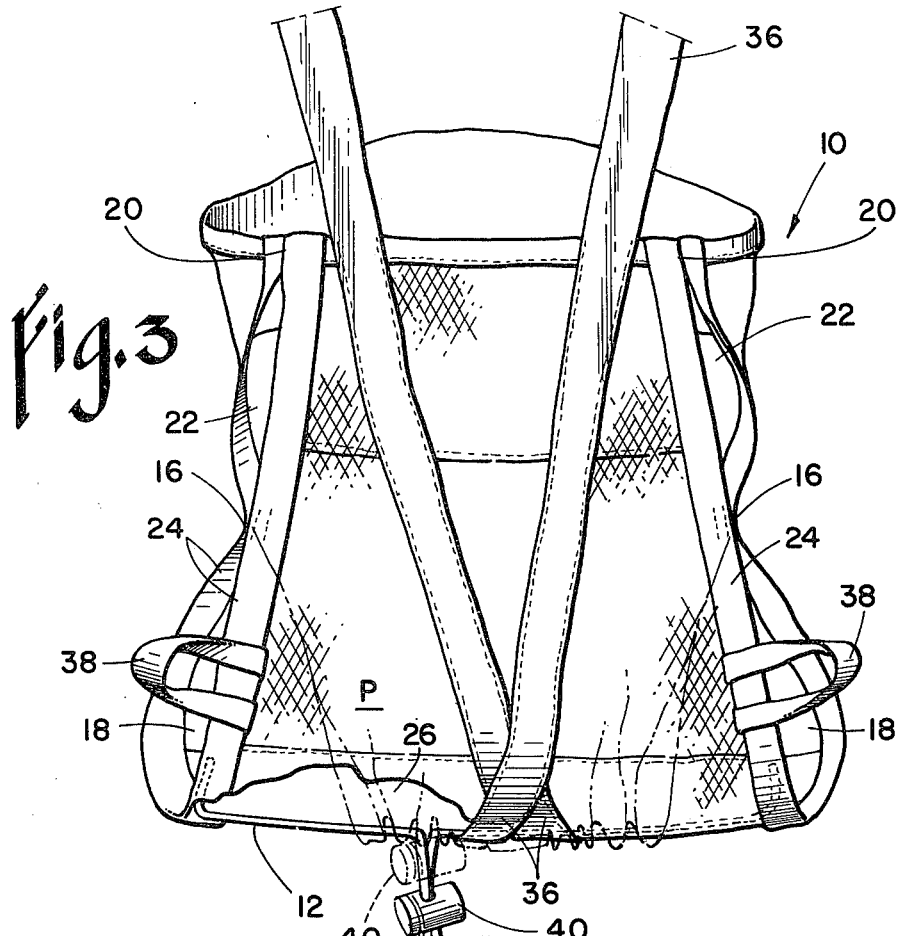
Figure 4:
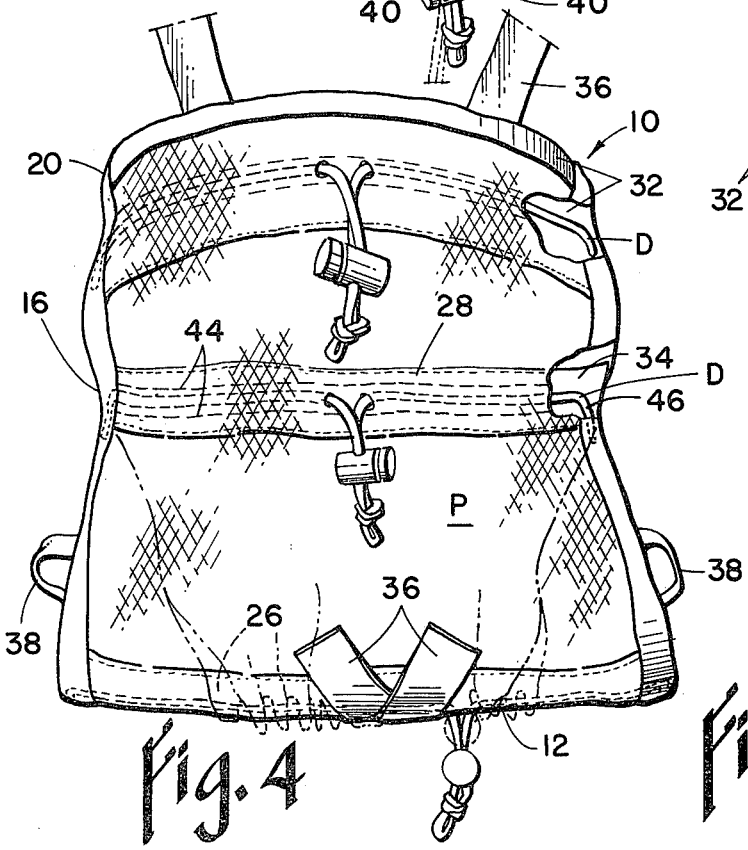
Figure 5:
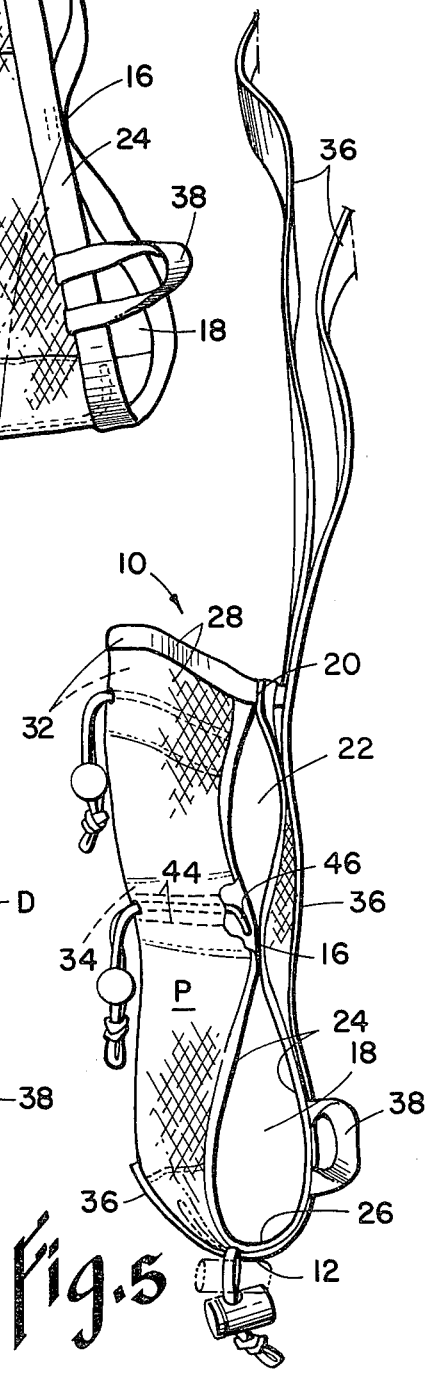

FIG. 3 is a fragmentary elevational view to an enlarged scale showing the front face of the carrier that lies against the adult's body, the full line position showing the unit fully extended to accommodate a large child while the phantom line position demonstrates how it is gathered in at the sides and seat for use by the very young infant, portions of the shoulder straps having been broken off to conserve space while other portions have been broken away to more clearly reveal the interior construction;

FIG. 4 is a fragmentary elevational view similar to FIG. 3 and to the same scale but showing the rear face of the carrier remote from the body of the adult with the shoulder straps broken off and other portions broken away to better show the interior construction;

FIG. 5 is a side elevation of the carrier to the same scale as FIGS. 3 and 4; and, FIG. 6 is a diagram revealing the interaction between the crotch liner, waistband and neckband in cooperation with the main fabric panel which cooperate to define the drawstring retaining channels in these three areas.

Figure 1:
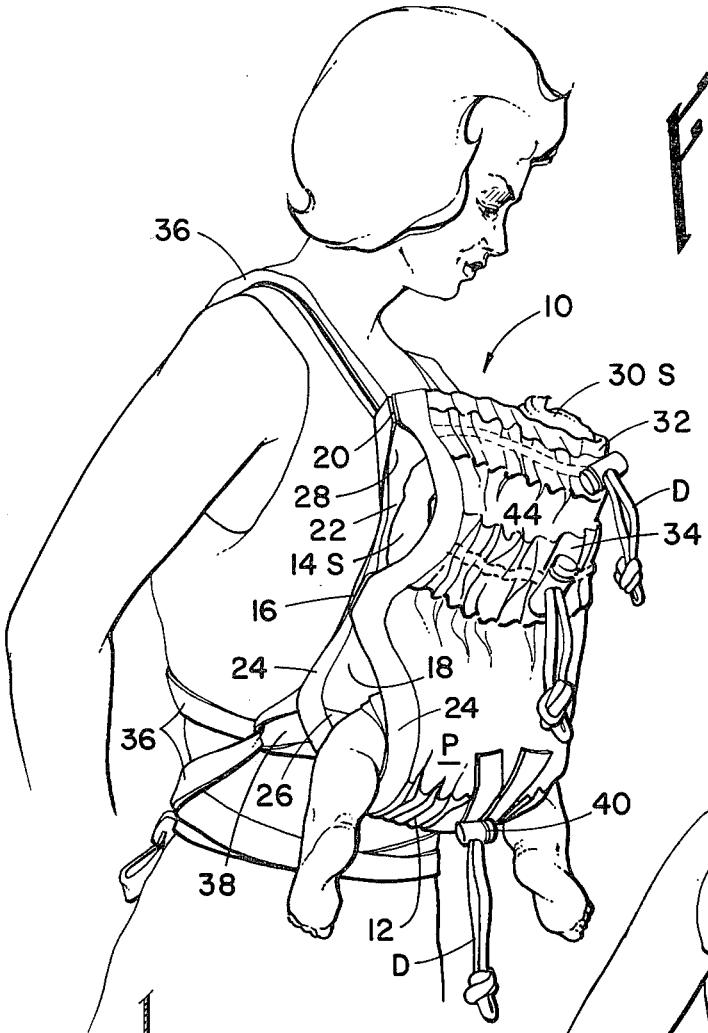
FIG. 1 is a perspective view from the left side showing the pouch-type carrier adjusted to carry an infant no more than a few weeks old, the child having been shown inside thereof supported upon the chest of the mother.
Figure 2:
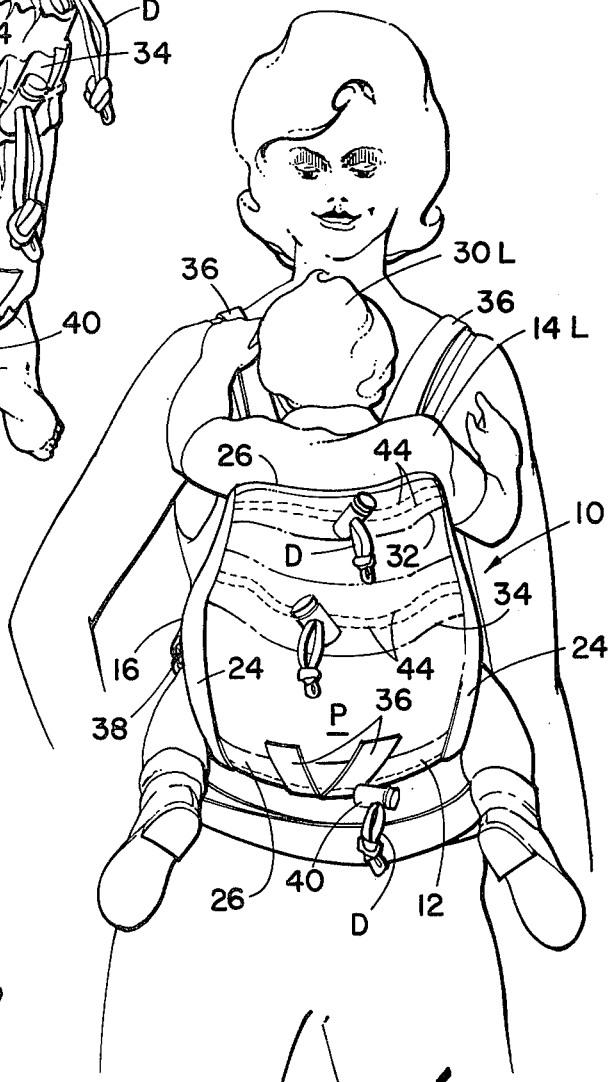
FIG. 2 is a perspective view from the front showing the same carrier adjusted to carry a much larger child similarly supported on the mother's chest.

Referring next to the drawings for a detailed description of the present invention and, initially, to FIGS. 3, 4 and 5 for this purpose, reference numeral 10 has been selected to broadly identify the infant carrier which will be seen in the particular form shown to comprise a single elongate fabric panel P folded more or less in half transversely so as to define an open-topped pouch closed at the bottom 12 to produce a seat supporting the buttocks and back of the thighs of a small child 14 in the manner which will be described in greater detail presently in connection with FIGS. 1 and 2. Panel P is preferably contoured in a manner well known in the art, especially at the rear, to provide a concave shape better suited to conform to the child's back as seen in FIG. 5. The sides are sewn or otherwise fastened together approximately half way up as shown most clearly at 16 in FIG. 3 so as to leave leg openings 18 between it and the bottom 12. The sides are also sewn or otherwise fastened together at the top as indicated at 20. The latter stitching cooperates with the stitched area 16 therebeneath to define armholes 22 for the smaller child (FIG. 1) who cannot hang his or her arms over the top like the large child 14L (FIG. 2). Strips of cloth binding or the like 24 are, in the particular form shown, folded over the side margins of the fabric panel P and sewn thereto as both a binding and a reinforcement. The bottom or crotch area is similarly reinforced as well as lined with a transversely-extending solid fabric liner 26.

Since the pouch-type carrier of the present invention can be worn on either the chest of the adult as shown in FIGS. 1 and 2 or, alternatively, on the back in more or less "papoose fashion", it will facilitate the present description of the elements of the carrier 10 are oriented relative to the child being carried rather than the adult since, for all practical purposes, the child is always in a position facing the adult irrespective of which way the carrier is deployed. Accordingly, the "front" of the carrier will be that which the child faces and the rear will, of course, be that against which his or her back rests.

With this in mind, it can be seen in FIGS. 1, 3 and 6 that another transversely-extending fabric liner 28 is folded over the top front edge of panel P and sewn thereto so as to extend down inside for a distance adapted to define a soft moisture-absorbent bib facing the head 30S of the small child 14S much in the manner shown in FIG. 1. FIGS. 1, 2, 4, 5 and 6, on the other hand, most clearly reveal a somewhat narrower, but nonetheless similar, transversely-extending fabric band 32 bordering the top rear edge of the carrier behind the child's head or neck as the case may be. The aforementioned band both pads the head or neck and binds the top edge while, at the same time, cooperating with main panel P in a manner to be described in greater detail presently to define a channel C for retaining drawstring D, the latter having been revealed most clearly in FIG. 6. In these same figures is revealed yet another transversely-extending waistband 34 on the rear inside face of the carrier bridging the space between stitched areas 16 at the sides. This band lies behind the child in the waist area of the larger child 14L of FIG. 2 and just underneath the shoulders of the smaller infant 14S of FIG. 1. In like manner to band 32 along the top, waistband 34 cooperates with main panel P to define a channel C for a second drawstring D at the waist. The most significant drawstring D of all is that which extends across the bottom of the carrier in the channel C defined between the folded portion of main panel P and crotch liner 26. Before describing these three drawstrings and their functions, however, they will be better understood if the means by which the leg openings are kept spread apart is explained first for which purpose reference will be made from time to time with all six figures of the drawings.

In the preferred and most unique version of the carrier, the shoulder straps perform the dual function of supporting the carrier and child on the chest or back of an adult in the usual way while, in addition, acting as the belt which maintains the spread relation between the leg openings. Specifically, a pair of shoulder straps 36 are employed, each being initially secured to the carrier within the crotch area as shown so as to pass up the front in divergent relation to final points of attachment alongside the armholes 20. In the preferred construction, these straps cross one another in the crotch and diverge upwardly from there. They are sewn or otherwise fastened to the panel P all the way along and thus provide a secure harness for supporting the carrier. In addition, a pair of shoulder strap loops 38 are disposed on the front side margins of the carrier alongside each of the two leg openings 18. These loops receive the shoulder straps in the manner shown in FIGS. 1 and 2 and cooperate with the crotch drawstring to vary the spacing between the leg openings. A simple version of the carrier is one in which the shoulder straps are terminated at the point where they return to the side margins of the front panel under the arms and a separate belt-forming appendage is attached to the panel in such a way that it can be drawn taut and secured in some manner so as to maintain the desired spread between the leg openings. Both systems, of course, cooperate with the seat drawstring subassembly to achieve the identical end result.

The manner of adjusting and using the carrier to support a small infant 14S will now be examined in connection with FIGS. 1 and 3. Starting with the carrier in the fully-extended position shown in full lines in FIG. 3, the crotch drawstring is pulled to narrow the spacing between the leg openings 18 to just that which will support the buttocks and back of the thighs of the infant when spread-eagled as shown in FIG. 1 while still permitting the forelegs and feet to hang down freely. Essentially, this means that the leg openings lie just behind the knees. Such a position is represented by phantom lines in FIG. 3 where it will be seen that the crotch liner 26 is gathered to a considerable degree, the drawstring D is much extended, and drawstring lock 40 is pushed up snug against the seat of the pouch. Essentially, this same condition is represented by full lines in FIG. 1.

At this point, however, the infant can still squeeze his or her legs together and further narrow the space separating the leg openings. As previously noted, this is undesirable from an orthopedic standpoint and the child's legs should be supported in the spread position of FIG. 1. Now, to maintain this spread position, the mother or other adult carrying the child need only actuate whatever is provided for pulling the leg openings apart and secure it in the position of maximum spread permitted by the seat drawstring. In the case of a separate belt, the shoulder straps would be secured to the sides of the carrier first and then the belt pulled taut and tied or otherwise secured. In the preferred version illustrated when the shoulder straps function as the belt that keeps the leg openings spread apart, the adult carrying the child need only pass the shoulder straps 36 over the shoulders, cross them behind the back, then pass them forwardly again under the arms before moving the ends through loops 38, and finally passing the straps back around the waist and tying them together behind the back. If this is done as shown in FIG. 1, the tied straps will pull the front of the carrier out as wide as it can go before the partially retracted crotch drawstring prevents further spreading thereof. In so doing, the shoulder strap/strap-receiving loop subassembly cooperates in a unique and beneficial way with the crotch drawstring subassembly to maintain the leg openings in precisely the desired fixed spaced relation to one another. The infant 14S of FIG. 1 is so small that the head 30S lies almost totally inside the carrier. These very young infants generally keep their arms inside the pouch also as illustrated. Because of their small size, the waist and neck drawstring subassemblies can be similarly actuated to narrow the width of the pouch as shown; however, no novelty is claimed for these features nor do they coact in the same way with the shoulder straps and shoulder strap loops as does the crotch drawstring.

It should, perhaps, be mentioned at this point that the same cooperative relationship is obtained when the child is carried on the back as opposed to the chest. The shoulder straps are generally left uncrossed on the chest but they still pass back under the arms where they are either terminated and the separate belt used or passed through the loops 38, then forwardly again around the waist before being tied in front. Either way, the resultant effect of holding the front panel in spread relation along the bottom to whatever extent is permitted by pre-adjustment of the crotch drawstring is still present to the same degree it is when the child is carried on the chest.

FIGS. 2 and 3 illustrate the use of the carrier for the larger child 14L in full lines. If, as shown, the distance between the child's forelegs in essentially spread-eagle position is such that the crotch can be left fully extended, there is obviously no necessity for tightening the crotch drawstring. Nevertheless, the separate belt or shoulder strap/shoulder-strap loop subassembly will function as before to maintain this desired maximum spacing. FIGS. 1 and 2, therefore, represent the extremes of adjustment while it is to be understood that all positions therebetween can be accommodated. The large child of FIG. 2 sits with his or her legs supported in the seat of the carrier in exactly the same way as the very small child of FIG. 1. The waist and neck area drawstring subassemblies can probably be left fully extended as shown in FIG. 2 with the larger child who, oftentimes, will have his or her arms, shoulders and head completely outside the pouch so that only the leg openings in the sides are used, not the armholes. The maximum orthopedic advantages of the carrier are realized from shortly after birth up to, say, a year and a half old. After that, the skeletal system is fully enough developed to require no further support of the type provided by the instant carrier and its function, therefore, returns to the one its predecessor has fulfilled so adequately over the many years the latter has been on the market.

With the exception of FIG. 3, all the remaining figures show the drawstring subassemblies with some degree of particularity; however, the overall construction of the carrier can, perhaps, best be seen in the diagram of FIG. 6 to which detailed reference will now be made. The main panel P is backed up in each of the three areas (neck, waist and crotch) where a drawstring D is found by a transversely-extending fabric panel of some sort, the one in the crotch being crotch liner 26, the one in the middle comprising waistband 34 and the third neckband 32. The side margins of each of these bands are folded over and the resulting double thickness of material sewn to the panel P in the usual manner to produce a smooth hem as indicated at 42. Spaced parallel rows of stitching 44 interconnecting the medial portion of each band (26, 34 and 32) with the opposed surface of the main panel cooperate to define the drawstring channels C in each instance. Shoulder straps 36 are shown in FIG. 6 sewn to the panel P only at intervals; however, in the actual carrier, they are preferably sewn thereto all the way along. FIGS. 4 and 5 have been broken away in area of the waistband to show how the ends 46 of the drawstrings are terminated and sewn within the tapes 24 binding the side margins. The ends of the neckband drawstring are fastened at 20, those of the waistband at 26 and those in the crotch in the bottom of the fold.

What is claimed is:

1. In an infant carrier of the type having front and rear soft fabric panels connected along the bottom and at spaced points on both sides to define an open-topped pouch with a seat in the bottom, leg openings at the sides of the seat and armholes above the leg openings; and, supporting means connected to one of the panels for carrying said pouch on the chest or back, the improvement which comprises: adjustment means arranged transversely of the seat operative upon actuation to narrow the distance separating the leg openings, and belt-forming means connectable alongside each leg opening operative upon actuation to maintain the maximum spread relation therebetween permitted by said seat width adjustment means.

2. The improvement as set forth in claim 1 wherein: the belt-forming means comprise a pair of shoulder straps functioning as the supporting means for the carrier, and wherein strap-receiving means are provided alongside each leg opening for receiving one of the shoulder straps after being passed over the shoulder and under the arm preparatory to tying same at the waist on the opposite side of the body from that upon which the pouch is carried, said shoulder straps and strap-receiving means cooperating with one another and with the adjustment means when said straps are thus reaved, pulled taut and tied to maintain a preselected fixed spaced relationship between the leg openings.

3. The improvement as set forth in claim 1 wherein: the adjustment means comprises a drawstring having end portions connected alongside the leg openings and a medial portion accessible therebetween, said medial portion when pulled being effective to move said ends and the adjacent leg openings closed together.

4. The improvement as set forth in claim 1 wherein: a waist-adjustment means is located between the leg openings and armholes extending transversely therebetween, said means being operative upon actuation to gather the pouch in at the waist.

5. The improvement as set forth in claim 1 wherein: an adjustment means is located at the open top of the pouch extending transversely thereof and operative upon actuation to narrow the opening therein.

6. The improvement as set forth in claim 2 wherein: the strap-receiving means comprise loops affixed to the portions of the front panel alongside the leg openings.

7. The improvement as set forth in claim 3 wherein: locking means is provided upon the medial portion of the drawstring operative upon actuation to releasably latch same in adjusted position.

8. The improvement as set forth in claim 4 wherein: said waist-adjustment means comprises a drawstring subassembly including a drawstring and locking mechanism therefor.

9. The improvement as set forth in claim 5 wherein: said neck adjustment means comprises a drawstring subassembly including a drawstring and a locking mechanism therefor.

* * * * *